US005787530A

United States Patent [19]

Brix

[11] Patent Number: 5,787,530

[45] Date of Patent: Aug. 4, 1998

[54] APPARATUS AND METHOD FOR BED ACCESS ASSISTANCE

[76] Inventor: Ruth Brix, 622 N. Rochester St., Mesa, Ariz. 85205

[21] Appl. No.: 537,087

[22] Filed: Sep. 29, 1995

[51] Int. Cl.[6] ..... A47C 21/00

[52] U.S. Cl. ..... 5/662; 5/424; 5/659; 5/503.1; 5/658

[58] Field of Search ..... 5/426, 425, 662, 5/424, 659, 503.1, 658

[56] References Cited

U.S. PATENT DOCUMENTS

| | | | |
|---|---|---|---|
| 2,991,487 | 7/1961 | Beckwell | 5/426 |
| 3,290,701 | 12/1966 | Luff | 5/426 |
| 4,836,523 | 6/1989 | Englander | 5/662 |
| 5,400,450 | 3/1995 | Ceoutsekos | 5/662 |
| 5,437,067 | 8/1995 | Bernstein et al. | 5/426 |
| 5,448,791 | 9/1995 | Brown | 5/425 |
| 5,471,689 | 12/1995 | Shaw et al. | 5/662 |

*Primary Examiner*—Brian K. Green
*Assistant Examiner*—Fredrick Conley
*Attorney, Agent, or Firm*—Harry M. Weiss; Jeffrey D. Moy; Harry M. Weiss & Associates, P.C.

[57] ABSTRACT

A bed access assistance apparatus and method for aiding individuals with less than full mobility in getting into and out of a bed. The apparatus and method are represented by a single unit that slips between the mattress and mattress support, such as a box spring, with a vertical hand grip that resides adjacent to the mattress on the preferred side of access. The apparatus and method do not rely on fastening to the bed frame and thus form an independent, portable unit.

20 Claims, 1 Drawing Sheet

APPARATUS AND METHOD FOR BED ACCESS ASSISTANCE

BACKGROUND OF THE INVENTION

1. Field of the Invention

This invention is in the field of assisting individuals with less than full mobility access to and from a bed, and, more particularly, is an apparatus and a method for assisting a user in getting into and out of a bed.

2. Description o f the Related Art

Prior inventions which lend assistance to users with less than full mobility in getting into and out of bed have relied on complex devices which must be fastened onto a bed frame. Examples of such prior art is found in U.S. Pat. Nos. 5,195,200 of Mar. 23, 1993 (Leoutsakos) and 5,231,721 of Aug. 3, 1993 (Fish). Leoutsakos embodies a hand grip type device which permanently attaches to the side rail of a bed frame by means of support brace held in place by bolts and clip members. Fish describes a bedside grab bar that attaches by means of clamps to a unique bed frame, thereby providing assistance the user.

The limitation of the Leoutsakos and Fish inventions is that both inventions require complex attachment means to a bed frame. Once attached to the bed frame the Leoutsakos and Fish inventions may not be removed or repositioned without significant manipulation, time and effort. The present invention traverses this limitation by allowing contemporaneous, unhindered portability.

U.S. Pat. No. 3,553,746 of Jan. 12, 1971 (Seiger) envisions a support device for helping a person out of bed. Seiger relies on a hand grip member which is attached to a stand, which stand in turn resides on the floor adjacent to the user's bed. The primary limitation to this device is that the leverage offered to the user during entrance and egress from a bed is restricted by the failure of the device to be anchored to a fixed, immovable object such as the floor or the bed itself.

Conceding that the Seiger device is both portable and usable on either side of a bed, the very features that give the device these capabilities, namely attaching the handgrip to a stand alone base, are the same features that limits it's usefulness for want of adequate leverage. The present invention traverses this limitation of insufficient leverage.

The trade off between adequate leverage and portability is nowhere more apparent than as found in U.S. Pat. No. 4,932,090 of Jun. 1990 (Johansson). The Johansson invention effectively demonstrates two embodiments. The bed frame mounted embodiment is similar to U.S. Pat. No. 3,863,282 of Feb. 4, 1975 (Stillwell) where a pivoting hand grip is mounted to the bed frame. Thus, these embodiments face the same limitations as Leoutsakos and Fish, that is a complex, permanent attachment to the bed frame.

The second embodiment of Johansson is a pivoting hand grip mounted to a floor base, thus similar to Seiger. However, Johansson correctly anticipated the leverage limitation of Seiger and traversed this limitation by permanently attaching the floor base to the floor by means of bolting or other permanent fixture means. Therefore, the Johansson floor embodiment has sacrificed the portability element offered by Seiger for adequate leverage and now suffers from the similar complex, permanent attachment limitations of Leoutsakos, Fish and Stillwell.

Conceptually different approaches have relied on trapeze bars, which are suspended above the user's bed and which require the user to reach up and grab for assistance. Such an approach can be found in U.S. Pat. No. 4,686,727. The limitation on these trapeze embodiments is that they provided minimal lateral leverage. Therefore, there existed a need to provide such an improved apparatus and a method for assisting users in getting into and out of bed. The present invention affords the user adequate lateral leverage simultaneously with a single, portable unit that simply and expeditiously attaches to a bed.

SUMMARY OF THE INVENTION

According to the present invention, an apparatus and method for assisting access to and from a bed includes two primary parts: a horizontal member means and a vertical member means. A tubular hand grip member is included within the vertical member means.

An object of the present invention is to provide a convenient apparatus and method for individuals with reduced mobility assistance in getting into and out of a bed.

Another object of the present invention is to provide a convenient apparatus and method for bed access assistance that may be simply and expeditiously attached to a bed without extraneous tools, supplemental hardware, or modifications to the bed or bed frame.

Another object of the present invention is to provide a convenient apparatus and method for bed access assistance that is equally functional on both sides of a bed and that is readily portable, storable and attachable.

The foregoing and other objects, features, and advantages of the invention will be apparent from the following, more particular, description of the preferred embodiments of the invention, as illustrated in the accompanying drawings.

BRIEF DESCRIPTION OF THE PREFERRED EMBODIMENTS

An object of the present invention is to provide an apparatus and method therefore for assisting a user in getting into and out of a bed comprising, in combination: horizontal member means inserted into a portion of the bed for holding the apparatus in place; and vertical member means coupled to the horizontal member means for providing support to the user while getting into and out of the bed.

The horizontal member means has an upper surface that contacts a lower surface of a mattress of the bed and a lower surface that contacts an upper surface of a mattress support of the bed. Therefore the apparatus is held in place within the bed by inserting it between the mattress and mattress support.

One embodiment of the invention has a horizontal member means that comprises of a first member having a first lengthwise dimension, and a second member, coupled to the first member and to the vertical member means, the second member having a second lengthwise dimension shorter than the first lengthwise dimension.

The horizontal member means is symmetric with respect to the vertical member means such that the apparatus is equally functional on both sides of the bed.

The vertical member means is coupled orthogonally to the horizontal member means. The vertical member means comprises of a rectangular member having an inner surface adjacent to a side portion of the bed; and tubular member means coupled to the rectangular member for providing a hand grip for the user.

The tubular member means is coupled to an upper portion of the rectangular member. One embodiment of the tubular member means has an inverted U configuration.

The apparatus constitutes an integral, portable unit.

DESCRIPTION OF THE PREFERRED EMBODIMENTS

Figure 1:
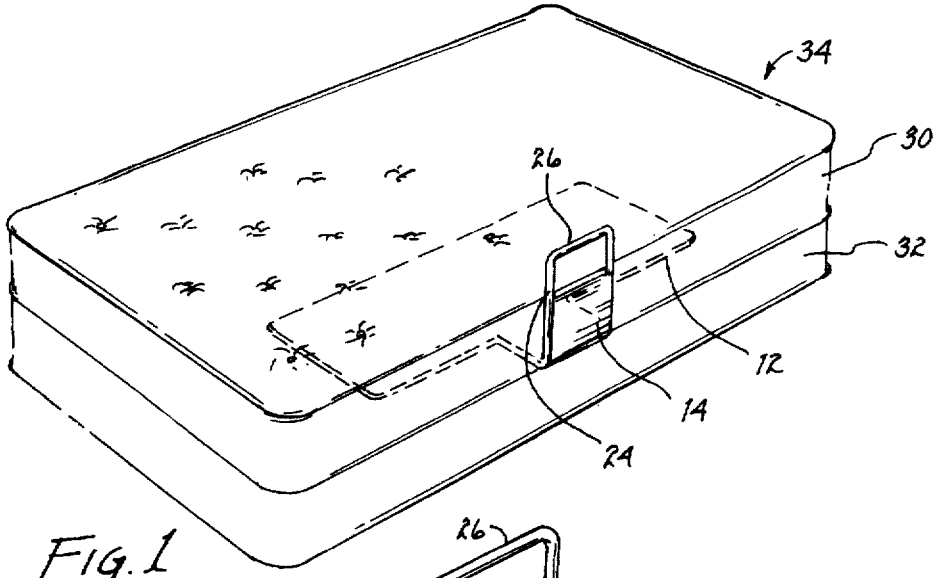
FIG. 1 is a perspective view of one embodiment of the present invention as seen in use with a typical bed.
Figure 2:
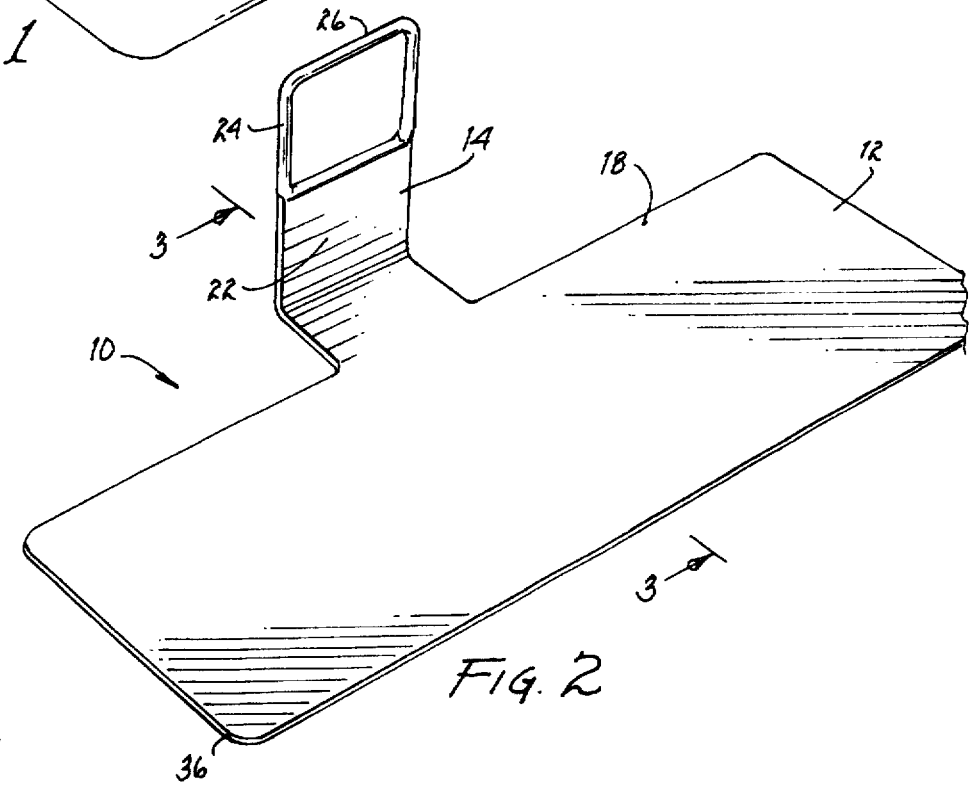
FIG. 2 is a perspective view of one embodiment of the present invention from a frontal elevation.
Figure 3:
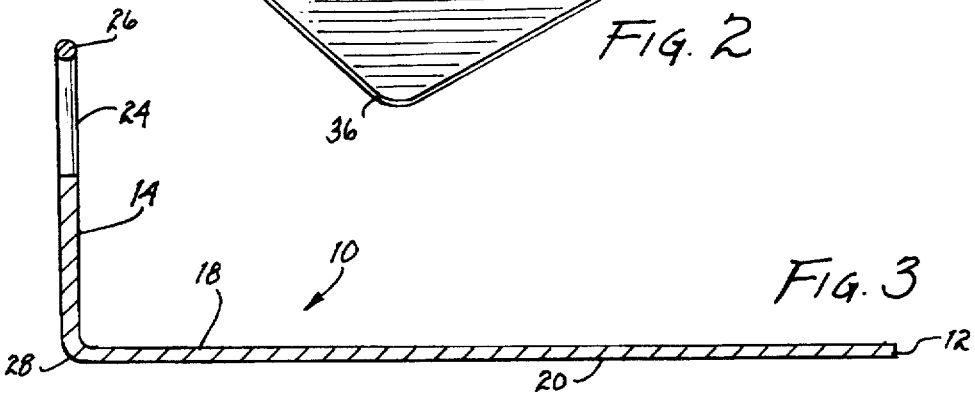
FIG. 3 is a cross-sectional view of one embodiment of the present invention taken along line 3—3 of FIG. 2.

FIG. 1 illustrates the invention in use with a typical bed. FIGS. 2 & 3 illustrate the preferred embodiments of the invention. The bed access assistance apparatus 10 in FIG. 2 comprising of a horizontal member means 12 which is substantially rectangular in form and a vertical member means 14 which is also substantially rectangular in form. The horizontal member means 12 and the vertical member means 14 are manufactured either in one or two pieces, as desired, and in any form of suitable material such as plastic or metal, etc.

The horizontal member means 12 in FIG. 2 is further defined by including a rectangular, coplanar horizontal tab member 16 to which the vertical member means 14 is orthogonally coupled with rounded corner 28.

The horizontal member means 12 in FIG. 3 has an upper surface 18 which contacts the lower surface of a mattress 30 when the apparatus 10 is inserted into a bed as in FIG. 1. The horizontal member means 12 also has a lower surface 20 which contacts the upper surface of a mattress support 32 when inserted in a bed. The thickness of the horizontal member means 12 is sufficient to provide adequate strength and rigidity to the apparatus 10, while preserving the apparatus 10 as lightweight and portable. The horizontal member means 12 is further defined as having rounded corners 36.

The vertical member means 14 in FIG. 2 has a inner surface 22 that contacts the side of the mattress 30 when the apparatus 10 is inserted in the bed 34 as in FIG. 1.

The vertical member means 14 in FIG. 2 is further defined as including a tubular member 24 in the form of an inverted U. The tubular member 24 provides a hand grip 26 to assist the user when getting into or out of the bed 34.

The user may make use of the apparatus 12 by inserting it between the mattress 30 and mattress support 32 of a typical bed 34 such that the inner surface 22 of the vertical member means 14 is flush with the side of the mattress 30 as in FIG. 1. When getting into bed 34 the user may grab the hand grip 26 to ease their weight onto the bed 34. The weight of the mattress 30 will prevent movement of the apparatus during bed entry.

When egressing from a bed 34 the user may grab the hand grip 26 as shown in FIG. 1 to assist the user in transitioning from a horizontal to an erect posture. The weight of the user together with the weight of the mattress 30 will prevent movement of the apparatus 10 when eggressing from a bed 34.

The apparatus 10 may be easily removed from a bed 34 as in FIG. 1 by grasping the tubular member 24 and exerting a lateral force such that the device slips out from between the mattress 30 and the mattress support 32.

The horizontal member means 12 is symmetrical about the vertical member means 14, as shown in FIG. 2, such that the apparatus 10 may have equally functionality on both sides of a bed 34 or at the foot or head of a bed 34 should such access be desired by the user.

The apparatus 10 is a single, integral, portable unit as in FIG. 2 that may be easily inserted, removed and transported by one person of average strength. The dimensions of the apparatus 10 are such that it may be inserted into any bed 34 of conventional size including, but not limited to twin size, full size, queen size and king size; and may be stored in a closet of average size or underneath a typical bed 34 as described above.

Although the invention has been particularly shown and described with reference to a preferred embodiment thereof, it will be understood by those skilled in the art that changes in form and detail may be made therein without departing from the spirit and scope of the invention. For example, member 14 can have a height of about 15 inches, the opening in member 14 can be about 6 to 7 inches by about 4 to 5 inches, the width of the about 9 to 10 inches, member 16 can be about 9 to 10 inches long, the member 12 can be from about 48 inches by about 15 inches in dimension and from about 0.5 to about 1.0 inches in thickness.

What is claimed is:

1. An apparatus for assisting a user in getting into and out of a bed comprising, in combination:

a bed having a mattress with a height, width, and a length;

horizontal member means for removable attachment to said bed and for insertion into a portion of said bed for holding said horizontal member means in place, said horizontal member means having a width less than half of the width of said bed and having a length, said horizontal member means having a coplanar, rectangular horizontal tab member extending outwardly from only one side of said horizontal member means; and vertical member means fixedly and immovably connected to only one side of said horizontal tab member of said horizontal member means for providing support to said user while getting into and out of said bed, said vertical member means having a length substantially smaller than said length of said horizontal member means and height greater than said height of said mattress.

2. The apparatus of claim 1 wherein said horizontal member means has an upper surface that contacts a lower surface of a mattress of said bed.

3. The apparatus of claim 1 wherein said horizontal member means has a lower surface that contacts an upper surface of a mattress support of said bed.

4. The apparatus of claim 1 wherein said horizontal member means comprises:

a first member having a first lengthwise dimension, and said horizontal tab member coupled to said first member and to said vertical member means, said horizontal tab member having a second lengthwise dimension shorter than said first lengthwise dimension.

5. The apparatus of claim 1 wherein said horizontal member means is symmetric with respect to said vertical member means such that said apparatus is equally functional on both sides of said bed.

6. The apparatus of claim 1 wherein said vertical member means is coupled orthogonally to said horizontal tab member of said horizontal member means.

7. The apparatus of claim 6 wherein said vertical member means comprises:

a rectangular member having an inner surface adjacent to a side portion of said bed; and tubular member means coupled to said rectangular member for providing a hand grip for said user.

8. The apparatus of claim 7 wherein said tubular member means is coupled to an upper portion of said rectangular member.

9. The apparatus of claim 7 wherein said tubular member means has an inverted U configuration.

10. The apparatus of claim 1 wherein said apparatus constitutes a portable unit.

11. A method for assisting a user in getting into and out of a bed comprising the steps of:

providing a bed having a mattress with a height, width, and a length;

providing horizontal member means comprising a single flat member for removable attachment to said bed and for insertion into a portion of said bed for holding said horizontal member means in place, said horizontal member means having a width less than half of the width of said bed and having a length, said horizontal member means having a coplanar, rectangular horizontal tab member extending outwardly from only one side of said horizontal member means; and providing vertical member means fixedly and immovably connected to only one side of said horizontal tab member of said horizontal member means for providing support to said user while getting into and out of said bed, said vertical member means having a length substantially smaller than said length of said horizontal member means and a height greater than said height of said mattress.

12. The method of claim 11 wherein said horizontal member means comprises an upper surface that contacts a lower surface of a mattress of said bed.

13. The method of claim 11 wherein said horizontal member means comprises a lower surface that contacts an upper surface of a mattress support of said bed.

14. The method of claim 11 wherein said step of providing said horizontal member means comprises the steps of:

providing a first member having a first lengthwise dimension, and providing said horizontal tab member coupled to said first member and to said vertical member means, said horizontal tab member having a second lengthwise dimension shorter than said first lengthwise dimension.

15. The method of claim 11 wherein said horizontal member means is symmetric with respect to said vertical member means such that said apparatus is equally functional on both sides of said bed.

16. The method of claim 11 wherein said vertical member means is coupled orthogonally to said horizontal tab member of said horizontal member means.

17. The method of claim 16 wherein said step of providing said vertical member means comprises the steps of:

providing a rectangular member having an inner surface adjacent to a side portion of said bed; and providing tubular member means coupled to said rectangular member for providing a hand grip for said user.

18. The method of claim 17 wherein said tubular member means is coupled to an upper portion of said rectangular member.

19. The method of claim 17 wherein said tubular member means has an inverted U configuration.

20. An apparatus for assisting a user in getting into and out of a bed comprising, in combination:

a bed having a mattress with a height, width, and a length;

horizontal member means comprising a single flat member for removable attachment to said bed and for insertion into a portion of said bed for holding said horizontal member means in place, said horizontal member means having a width less than half of the width of said bed and having a length, said horizontal member means having a coplanar, rectangular horizontal tab member extending outwardly from only one side of said horizontal member means; and vertical member means fixedly and immovably connected to only one side of said horizontal tab member of said horizontal member means for providing support to said user while getting into and out of said bed, said vertical member means having a length substantially smaller than said length of said horizontal member means and a height greater than said height of said mattress;

said horizontal member means having an upper surface that contacts a lower surface of a mattress of said bed;

said horizontal member means having a lower surface that contacts an upper surface of a mattress support of said bed;

said horizontal member means comprising:

a first member having a first lengthwise dimension, and said horizontal tab member coupled to said first member and to said vertical member means, said horizontal tab member having a second lengthwise dimension shorter than said first lengthwise dimension;

said horizontal member means being symmetric with respect to said vertical member means such that said apparatus is equally functional on both sides of said bed, said horizontal tab member having a length in the range of about 9 to 10 inches between said vertical member means and said first member of said horizontal member means;

said vertical member means being coupled orthogonally to said horizontal member means;

said vertical member means having a height of about 15 inches and a width in the range of about 9 to 10 inches and comprising:

a rectangular member having an inner surface adjacent to a side portion of said bed; and tubular member means coupled to said rectangular member for providing a hand grip for said user;

said tubular member means being coupled to an upper portion of said rectangular member;

said tubular member means having an inverted U configuration; and said apparatus being a portable unit.

* * * * *